United States Patent [19]

Krulik et al.

[11] 3,940,270

[45] Feb. 24, 1976

[54] REPRODUCTION SYSTEM UTILIZING ION MODULATOR AND DIELECTRIC IMAGING SURFACE

[75] Inventors: Gerald A. Krulik, Washington, W. Va.; Harvey J. Sable, Cleveland, Ohio

[73] Assignee: Addressograph Multigraph Corporation, Cleveland, Ohio

[22] Filed: May 6, 1974

[21] Appl. No.: 467,391

[52] U.S. Cl. ..... 96/1.4; 355/3 DD

[51] Int. Cl.[2] ..... G03G 13/14

[58] Field of Search ..... 96/1 R, 1.4, 1.5; 355/3, 355/16

[56] References Cited

UNITED STATES PATENTS

| | | | |
|---|---|---|---|
| 3,220,324 | 11/1965 | Snelling | 96/1.1 |
| 3,321,385 | 5/1967 | Fazzari | 96/86 R |
| 3,761,173 | 9/1973 | Fotland | 96/1 R |

FOREIGN PATENTS OR APPLICATIONS

| | | | |
|---|---|---|---|
| 763,900 | 7/1967 | Canada | 96/1.5 |

*Primary Examiner*—David Klein
*Assistant Examiner*—John L. Goodrow
*Attorney, Agent, or Firm*—Michael A. Kondzella

[57] ABSTRACT

An electrophotographic system is described in which a photoconductive ion modulator screen is used in conjunction with an anodized aluminum dielectric imaging surface. This combination enables the steps of image transfer and fixing to be carried out simultaneously without destroying the latent image produced on the dielectric imaging surface.

A duplex anodized aluminum coating is prepared by forming a porous aluminum oxide layer by electrolytically oxidizing an aluminum surface and thereafter continuing the electrolytic oxidation under conditions which produce a barrier type aluminum oxide layer. The resulting duplex anodized aluminum coating containing both porous type aluminum oxide and barrier type aluminum oxide is used as the dielectric imaging surface in this electrophotographic system.

12 Claims, 3 Drawing Figures

REPRODUCTION SYSTEM UTILIZING ION MODULATOR AND DIELECTRIC IMAGING SURFACE

BACKGROUND OF THE INVENTION

This invention relates to electrophotographic reproduction systems and in particular to an electrophotographic process and apparatus in which an image is transferred from a novel dielectric surface to a receiving surface such as plain paper.

Electrophotographic processes are well known with many ramifications having been disclosed since the earliest disclosure thereof by Chester F. Carlson in U.S. Pat. No. 2,297,691. In that patent a photoconductive insulating material such as sulfur, anthracene, anthraquinone or selenium was utilized as the imaging surface. Since then various other types of photoconductors have been disclosed. Inorganic crystalline photoconductive compounds such as zinc oxide, used in an insulating organic resin binder, were disclosed in U.S. Pat. No. 3,121,006 to Arthur E. Middleton and Donald C. Reynolds. Various organic photoconductors have also been described as imaging surfaces. Polyvinylcarbazole is described as a photoconductor in U.S. Pat. No. 3,037,861 to H. Hoegl, O. Sus and W. Neugebauer. Other organic photoconductors which are known for this purpose include the polyvinylbenzocarbazoles disclosed in U.S. Pat. No. 3,751,246 to Helen C. Printy and Evan s. Baltazzi and the polyiodobenzocarbazoles described in U.S. Pat. No. 3,764,316 to Earl E. Dailey, Jerry M. Barton, Ralph L. Minnis and Evan S. Baltazzi, both assigned to the same assignee as this invention.

Other classes of organic photoconductors are the benzofluorenes and dibenzofluorenes described in U.S. Pat. No. 3,614,412 to William J. Hessel and the cumulenes described in U.S. Pat. Nos. 3,674,473 to Robert G. Blanchette also assigned to the same assignee as this invention.

The organic photoconductors are generally utilized in conjunction with a suitable sensitizer to extend the spectral range of the photoconductor. Dyes may be used for this purpose. Another class of materials which are widely used are the pi-acids. Representative of these compounds are the oxazolone and butenolide derivatives of fluorenone, described in U.s. Pat. No. 3,556,785 to Evan S. Baltazzi, the dicyanomethylene substituted fluorenes, described in U.S. Pat. No. 3,752,668 to Evan S. Baltazzi and the bianthrones described in U.S. Pat. No. 3,615,411 to William J. Hessel, all assigned to the same assignee as this invention.

Prior art electrophotographic processes in general consisted of uniformly charging a photoconductor electrostatically in the dark, exposing the uniformly charged photoconductor to a pattern of light and shadow corresponding to the image to be reproduced, whereby the photoconductor was selectively discharged in the light-struck areas, contacting the resulting latent electrostatic image with a contrasting colored dielectric powdered material known as a toner to develop the image and either permanently fixing the toned image to the photoconductive surface or transferring it to a suitable receiving material such as a sheet of paper and thereafter permanently fixing the visible image to such receiving material.

Instead of uniformly charging a photoconductive surface with an electrostatic charge, use has been made of a conductive grid or screen upon which is deposited a layer of photoconductor which itself is photoconductive and acts as an ion modulating device. The photoconductive screen is first uniformly charged and then exposed to the image to be reproduced so as to produce a latent electrostatic image thereupon. A stream of ions impinged upon the screen is modulated by the latent electrostatic image thereon so that a latent electrostatic image comparable to that on the screen is formed upon a dielectric imaging surface placed in the path of the ion stream. The resulting latent electrostatic image is then developed upon the imaging surface, transferred to a sheet of paper of other receiving material and then permanently fixed thereto. The use of such screens is described, for example, in U.S. Pat. No. 3,220,324 to Christopher Snelling.

The various prior art processes disclosed above have certain disadvantages. For example, where it is necessary to transfer a toned image from a photoconductive surface to a receiving material, such as a sheet of plain paper, it is necessary to use a corona discharge in order to accomplish the transfer. The primary disadvantage of using corona transfer is that the corona discharge destroys the usefulness of the latent image which must therefore be reformed for each copy. In addition in such processes the transferred image must be fixed following transfer, usually by means of heat or pressure. These shortcomings add process steps which put an upper limit on copying speed. Where the image is fixed upon the photoconductive surface itself, it is also necessary to use as the photoconductive surface a costly, specially formulated material such as zinc oxide coated paper rather than plain paper.

OBJECTS

It is a principal object of this invention to provide an electrophotographic reproduction system in which transfer of a toned image to a receiving material and fixing of the image are accomplished simultaneously.

Another object of this invention is to provide an electrophotographic duplicating system which is capable of producing a number of copies without re-imaging the original after production of the first and successive copies.

Another object of this invention is to provide a system for electrophotographic copying which is equipped with a dielectric surface which is hard and resistant to wear and which can be used for pressure fixing of a toned image.

Another object of this invention is to provide a dielectric surface which is capable of accepting an electrostatic charge of a relatively high potential and retaining the charge throughout the reproduction of a large number of copies.

Other objects and advantages of this invention will become apparent from the following detailed disclosure and description

SUMMARY OF THE INVENTION

It has been found that the combination of a photoconductive ion modulator and a duplex anodized aluminum dielectric imaging surface comprising both barrier type aluminum oxide and porous aluminum oxide can be used to achieve the above noted objects. Such duplex anodized aluminum layers can be made as thick as desired resulting in a sufficiently low capacitance to enable the dielectric surface to hold a relatively high potential, for example, one in the range of about from 500 volts to 1,000 volts. Thicknesses of about from 0.5 micron to 20 microns are preferred. Use of this combination results in a system which is capable of simultaneous transfer of a toned image from the dielectric imaging surface to plain paper and pressure fixing of the image thereon. Since the latent electrostatic image persists upon the dielectric surface after transfer it is unnecessary to re-image the original or reproduce the latent electrostatic image upon the dielectric surface from the ion screen modulator between successive copies which can be made by merely toning the dielectric surface each time a copy is desired.

Use of the system of this invention results in a simpler and faster process for a number of reasons. In the first place use of a thick dielectric layer results in a process exhibiting a faster imaging speed than has previously been realizable. In addition, obviating the need for creating the latent electrostatic image anew for each copy of the same original effects a higher speed process.

Other advantages in this system are that the dielectric surface is durable and wear resistant. This durability permits the use of sufficient pressure to achieve simultaneous transfer and fixing of the toned image. Since corona discharge is not used in transferring the image, the integrity of the latent electrostatic image upon the duplex anodized aluminum dielectric surface is retained and the image can be retoned, transferred and fixed many times without re-imaging.

DESCRIPTION OF THE PREFERRED EMBODIMENTS

Figure 1:
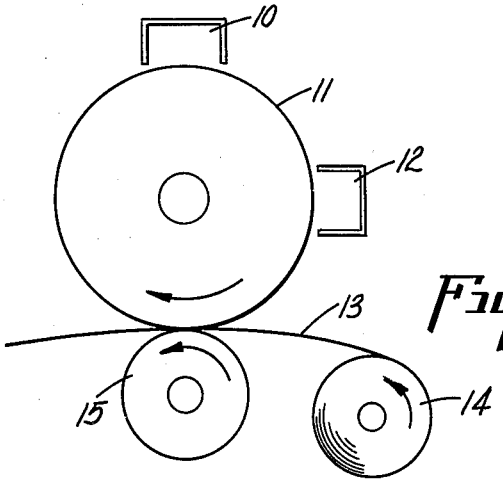
FIG. 1 is a diagrammatic view of an apparatus embodying the general features of this invention.

Referring to FIG. 1 an imaging unit 10 to be described hereafter in greater detail is positioned adjacent a drum 11. Downstream of imaging unit 10 adjacent to the drum 11 is positioned developing unit 12. Receiving material 13 is fed from supply roll 14 between drum 11 and pressure roll 15.

Imaging unit 10 functions to provide a latent electrostatic image upon the surface of drum 11 corresponding to an original which is to be reproduced. Drum 11 is rotated so that the resulting latent electrostatic image is advanced to developing unit 12 for development of the latent electrostatic image. Developing unit 12 may be any conventional type of developing device such as a cascade, powder cloud or magnetic brush developing device. The resulting developed image is then transferred from drum 11 to receiving material 13, which may be, for example, plain paper, by passing receiving material 13 between the surfaces of drum 11 and pressure roll 15. Simultaneous transfer and fixing of the developed image is achieved in this step since pressure roll 15 exerts sufficient pressure against the surface of drum 11 to both transfer the developed image from the surface of drum 11 to receiving material 13 and fix the image thereon.

Figure 2:
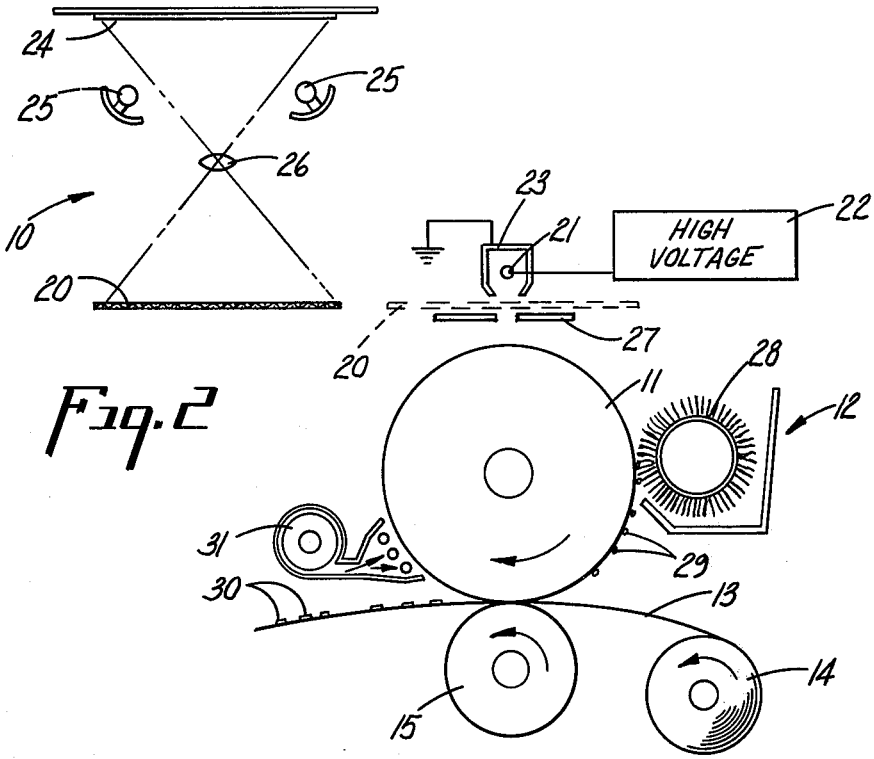
FIG. 2 is a diagrammatic view of a specific embodiment of this invention.

In FIG. 2 a specific embodiment of this invention is shown illustrating in some detail the various components used therein. In this embodiment imaging unit 10 includes ion modulator screen 20 which comprises a conductive screen and a coating thereon of a photoconductor. Screen 20 has imparted to it a uniform electrostatic charge in the dark by means of corona electrode 21 provided with high voltage source 22 and grounded shield 23. After the charging of the photoconductive layer of ion modulator screen 20 has been completed, the corona is shut off and original 24 to be reproduced is illuminated by means of lamps 25 whereby a pattern of light and shadow corresponding to original 24 is focussed upon ion modulator screen 20 by means of lens 26 resulting in selectively discharging those areas of the ion modulator screen corresponding to the light areas in the original. Corona electrode 21 is then turned on again, drum 11 is rotated and an ion stream is caused to impinge upon ion modulator screen 20 resulting in the passage through the screen and mask 27 of ions in a pattern corresponding to the original 24 and the formation of a latent electrostatic image upon the anodized aluminum dielectric surface of drum 11. Corona electrode 21 is then turned off and as drum 11 rotates the surface which carries the latent electrostatic image is moved into position adjacent developing unit 12 which includes magnetic brush 28. Toner particles 29 are applied by means of magnetic brush 28 and caused to adhere to the dielectric surface of drum 11 in a pattern corresponding to the original 24. As drum 11 continues to rotate the toned image held upon its surface by electrostatic charges is compressed between pressure roll 15 and drum 11 and transferred to receiving material 13, most suitably plain paper, which is fed from supply roll 14 to the nip between drum 11 and pressure roll 15. Contact between drum 11 and pressure roll 15 is made under pressure so that the toner carried by drum 11 in the form of a toned image is simultaneously transferred to receiving material 13 and permanently fixed thereon, as depicted at 30.

Due to the rotation of drum 11 beneath mask 27 the area subjected to imaging at any given time is made to approximate a flat surface.

If the machine described above is to be used for producing a single copy, the latent electrostatic image which is retained upon drum 11 following transfer and fixing can be easily removed by exposure to a stream of high humidity air as shown at 31 or by discharging with a suitable A.C. corona, not shown.

Where, however, more than one copy is desired the latent electrostatic image remaining upon the anodized aluminum surface of drum 11 following transfer of the toned image to receiving material 13 is rotated past imaging unit 10, which is shut off, to magnetic brush 28 for retoning and then to pressure roll 15 for transfer and fixing of the developed image as before. The foregoing cycle is repeated as many times as desired depending upon the number of copies which are to be made. Since the anodized aluminum surface of drum 11 is capable of retaining the latent electrostatic image for an extended period of time it is possible to make a large number of copies by this method. In this mode the machine functions as an electrostatic duplicator. Following the last transfer, that is, the production of the last copy desired in a given run, the latent electrostatic image remaining upon the anodized aluminum surface of drum 11 is removed as described above and the surface of drum 11 is ready for re-imaging to reproduce a different original.

Figure 3:
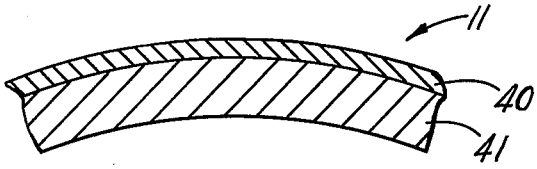
FIG. 3 is a diagrammatic cross-sectional view of an anodized aluminum surface such as used in this invention.

As shown in FIG. 3 drum 11 consists of anodized aluminum layer 40 overlying aluminum substrate 41. The anodized aluminum layer 40 is of a duplex type which contains both barrier type aluminum oxide, which functions as a dielectric and porous type aluminum oxide which functions as a conductor. Since the thickness of porous type aluminum oxide which can be produced can be as much as about 10,000 times the thickness of barrier type aluminum oxide it is readily apparent that significantly greater thicknesses of anodized aluminum can be produced by using a duplex type anodization than if the barrier type aluminum oxide, which is necessary for the anodized layer to act as a dielectric, is used by itself. As pointed out above this results in low capacitance and enables charging the dielectric to a relatively high potential.

In order to provide the duplex layers described above an aluminum surface is subjected to a first electrolytic oxidation in which a layer of porous type aluminum oxide is formed. After the desired thickness of porous aluminum oxide is produced the resulting anodized aluminum surface is subjectd to further electrolytic oxidation under conditions to produce barrier type aluminum oxide. It is not known whether the barrier aluminum oxide forms upon the surface of the porous aluminum oxide, at the interface between the aluminum and the porous aluminum oxide or in the pores of the porous aluminum oxide. In any event the desired dielectric character results.

The porous aluminum oxide layer is readily formed upon an aluminum surface by means of an electrolytic oxidation utilizing an electrolyte comprising a strong acid, for example, sulfuric acid, phosphoric acid, chromic acid, oxalic acid or sulfamic acid or a mixture of acids. Dilute solutions of the acid appear to be most effective in producing layers of the desired thickness although concentrated acids may be used as well. The electrical potential required for anodizing varies with the conditions of anodization. In general, potentials of about from 50 volts to 500 volts may be used. A potential at the lower end of the range, for instance, from about 50 volts to 200 volts is preferred.

Temperatures in the room temperature range are preferred for the sake of convenience. The range of about from 20°C to 25°C has been found satisfactory. The time necessary to provide the desired thickness of porous type aluminum oxide varies from a few minutes to several hours. Times in the range of about from 10 minutes to 2 hours have been found eminently satisfactory for this purpose.

Following the formation of the desired thickness of porous type aluminum oxide the electrolytic oxidation is continued using as electrolyte a bath which causes the formation of barrier type aluminum oxide, namely, a buffered acidic electrolyte.

In providing the requisite barrier type aluminum oxide the pH of the electrolyte should be buffered in the range of about from pH 6 to pH 9. Electrolytes in the range of from about pH 7 to pH 9 are preferred. Acids which may be used as electrolytes include such weak acids as citric acid, malic acid, glycolic acid and boric acid. In the case of boric acid baths an aqueous solution of a mixture of boric acid and borax can be used to provide the requisite buffered electrolyte. Such electrolyte can also include materials such as ethylene glycol which facilitate the formation of the barrier type aluminum oxide. The potential of the electrolytic cell in which the aluminum substrate is anodized should be controlled within the range of about from 100 volts to 700 volts. A voltage in the range of from about 200 volts to 400 volts is preferred. Using baths and potentials as above indicated a thickness of about from 5,000 angstroms to 10,000 angstroms of barrier type aluminum oxide can be obtained in a reasonable period of time. A convenient rule of thumb is that about 14 angstroms per volt is obtained utilizing the electrolytes described above.

Anodizing temperatures in the room temperature range are preferred with satisfactory results being obtained using temperatures in the range of about from 20°C to 25°C. The time necessary to provide the necessary barrier type aluminum oxide can vary from a few minutes to several hours. In general, it is found that about from 30 minutes to 2 hours is a range which provides satisfactory results. The utilization of diols or triols in the acid electrolytic baths as believed to facilitate the electrolytic oxidation by increasing the acidity of the bath without increasing the solvency of the bath for aluminum or aluminum oxide. Presumably, some sort of complex formation involving the acid and diol or triol is involved.

In order to achieve the results of simultaneous transferring and fixing of the toned image in this invention, it is necessary that a minimum pressure be exerted upon the receiving material which is passed between the anodized aluminum dielectric imaging surface and the pressure roll. It has been found that pressures in the range of about from 200 to 300 pounds per linear inch are effective for this purpose. These pressures can be achieved using a pressure roll of the type commonly used in pressure fixing in electrostatic copying machines. One type of such roll is a nylon covered steel roll which has the advantage over a plain steel roll that it is somewhat resilient.

For the pressure fixing of toned images it is desirable to use a toner in the developing system which is particularly adaptable to pressure fixing. A variety of toners of this kind are well known such as those described in U.S. Pat. No. 3,764,538 to Loren E. Shelffo and U.S. Pat. No. 3,775,326 to Virgil W. Westdale both assigned to the same assignee as this invention. It should be understood, of course, that various other toners are likewise useable in carrying out the process of this invention.

This invention will be better understood by reference to the following examples which are given for the purpose of illustration and are not intended to unduly limit the invention herein which is defined in the claims appended hereto.

EXAMPLE 1

A sample of aluminum sheet stock 8.5 cm. × 8.5 cm. and 0.081 cm. thick was pre-cleaned 5 minutes in a bath having the following composition:

| | |
|---|---|
| Phosphoric Acid ($H_3PO_4$) | 20 milliliters |
| Nitric Acid ($HNO_3$) | 30 milliliters |
| Water, deionized | 1 liter |

The resulting acid etched sample was then washed with deionized water and methanol and air dried. The sample was then suspended to a total anodizing area of 120 $cm^2$ in a bath of the following composition:

| | |
|---|---|
| Sulfuric Acid ($H_2SO_4$) | 90 grams |

-continued

| | |
|---|---|
| Water, deionized | 1 liter |

The bath was maintained at a temperature of 20°C. The aluminum sample was made the anode by connecting it to the positive terminal of a 0 – 100 volt D.C. power source. The negative terminal was connected to dual 9.5 cm. × 17.5 cm. stainless steel cathodes suspended in the bath parallel to the aluminum anode. Moderate stirring was provided with a magnetic stirrer. A current of 1 ampere was produced and the electrolytic oxidation continued for 30 minutes. Then the anodized aluminum sample was removed and transferred to a bath of the following composition:

| | |
|---|---|
| Boric Acid ($H_3BO_3$) | 90 grams |
| Sodium Tetraborate (Borax) ($Na_2B_4O_7 . 5 H_2O$) | 5.6 grams |
| Water, deionized | 1 liter |

A high voltage power supply giving 0 – 400 volts at a maximum current of 150 milliamperes was then connected with the same polarities and the voltage was adjusted to maintain the limit of current. After about 30 to 40 minutes the maximum supply voltage was attained at a current of approximately 10 – 20 milliamperes. The sample was then removed from the bath, rinsed in tap water and oven dried at 150°C for 30 minutes. The total thickness of the anodized layer was 8.5 microns (85,000 angstroms).

A latent image was projected onto the resulting duplex anodized aluminum surface by passing ions from a corona wire connected to the negative terminal of a 6,000 volt D.C. power supply through a 200 mesh stainless steel screen onto the anodozed aluminum surface. The screen was connected to the negative terminal of a 15,000 volt D.C. power supply and the aluminum on which the anodized aluminum layer had been deposited was connected to the positive terminal of the power supply. The ion stream from the corona wire was image-wise modulated by means of a silk-screen emulsion of a resolution target bonded to the downstream side of the screen.

The latent image which resulted was toned by hand using a magnetic brush and the resulting image was found to have excellent resolution with very little background.

EXAMPLE 2

The procedure of Example 1 was repeated using a 15 minute electrolytic oxidation in the first bath and as the second bath an electrolytic bath of the following composition:

| | |
|---|---|
| Boric Acid | 70 grams |
| Ethylene Glycol | 500 grams |
| Water, deionized | 500 grams |
| Ammonium hydroxide | (to adjust bath to pH 7.2) |

The results obtained using this bath were comparable to those observed in Example 1 except that the thickness of the anodized aluminum layer was 4.9 microns (49,000 angstroms).

EXAMPLE 3

A drum provided with the anodized aluminum surface produced by means of the electrolytic oxidation described in Example 1 was substituted for the imaging drum in a commercial electrophotographic copier, the Addressograph-Multigraph Model 5000, and was found to successfully transfer and fix a commercially available pressure fusible toner to plain paper.

EXAMPLE 4

The procedure of Example 2 was followed using as the first electrolyte a solution having the following composition:

| | |
|---|---|
| Formic Acid | 55 grams |
| Oxalic Acid | 80 grams |
| Water, deionized | 1 liter |

A current of 50 milliamperes was maintained for 30 minutes resulting in a porous type anodized aluminum layer 0.32 micron (3200 angstroms) thick. The total thickness of the anodized aluminum layer after treatment in both electrolytic baths was 0.75 micron (7500 angstroms).

EXAMPLE 5

The procedure of Example 4 was followed except that a current of 50 milliamperes was maintained in the oxalic/formic acid bath for a period of 1 hour resulting in a porous type anodized aluminum layer 0.75 micron (7500 angstroms) thick. The final thickness of the anodized aluminum layer following treatment in both electrolytes was 1.07 microns (10,700 angstroms).

EXAMPLE 6

The procedure of Example 2 was followed using as the first electrolyte a solution having the following composition:

| | |
|---|---|
| Oxalic Acid | 80 grams |
| Potassium hydrogen sulfate ($KHSO_4$) | 100 grams |
| Water, deionized | 1 liter |

The bath was of an acidity of pH 0.75. A current of 50 milliamperes was maintained for 15 minutes resulting in a porous type anodized aluminum layer 1.35 microns (13,500 angstroms) thick. The total thickness of the anodized aluminum layer after treatment in both electrolytic baths was 2.9 microns (29,000 angstroms).

EXAMPLE 7

The procedure of Example 6 was followed except that a current of 50 milliamperes was maintained for 30 minutes resulting in a thickness of porous type anodized aluminum layer of 0.83 micron (8300 angstroms) and a total thickness after both anodizations of 1.91 microns (19,100 angstroms).

EXAMPLE 8

The procedure of Example 2 was followed maintaining a current of 1 ampere for 1 hour in the first bath and a potential of 200 volts in the second bath. The total thickness of anodized aluminum layer was 16.7 microns (167,000 angstroms).

EXAMPLE 9

The anodized aluminum sample prepared in Example 8 was placed on a support 2 inches below a 2-wire negative corona source of 6000 volts and charged for 2 minutes. Immediately following the charging the sample was placed under a Monroe probe head for 4 seconds with the intial maximum voltage being recorded. The maximum voltage to which the sample was charged was 620 volts.

Although specific embodiments of the instant invention have been described for the purpose of illustration, it should be readily apparent that other embodiments may be devised using the system described in the foregoing description.

We claim:

1. A process for electrophotographic reproduction which comprises imparting a uniform electrostatic charge to a photoconductive ion modulator, exposing the charged ion modulator to a pattern of light and shadow corresponding to an original image which is to be reproduced, thereby producing a latent electrostatic image thereon, passing ions through the ion modulator carrying said latent electrostatic image to selectively impinge upon a duplex anodized aluminum dielectric surface comprising both barrier type aluminum oxide and porous type aluminum oxide on aluminum, thereby producing a latent electrostatic image thereon, developing said latent electrostatic image with toner particles to produce a toned image thereon, transferring said toned image to a receiving material and fixing said toned image upon said receiving material.

2. A process according to claim 1 wherein said transferring and fixing are accomplished simultaneously.

3. A process according to claim 1 wherein said duplex anodized aluminum dielectric surface is produced by anodizing an aluminum surface having a layer of porous aluminum oxide thereon under conditions to produce a barrier type aluminum oxide.

4. A process according to claim 1 wherein said duplex anodized aluminum dielectric has a thickness of about from 0.5 micron to 20 microns.

5. A process according to claim 1 wherein said receiving material is plain paper.

6. A process according to claim 1 wherein multiple copies are produced by repeating the developing, transferring and fixing steps without re-exposing said photoconductive ion modulator or reproducing the latent electrostatic image upon said dielectric surface between successive copies.

7. A process for producing a dielectric surface for use in an electrophotographic reproduction system which comprises electrolytically oxidizing aluminum under conditions to form porous type aluminum oxide and thereafter electrolytically oxidizing the aluminum having a porous type aluminum oxide layer thereon under conditions to form barrier type aluminum oxide.

8. A process according to claim 7 wherein an electrolyte comprising a strong acid is used for producing said porous type aluminum oxide.

9. A process according to claim 8 wherein said strong acid is sulfuric acid.

10. A process according to claim 7 wherein an electrolyte comprising a buffered solution of a weak acid is used for producing said barrier type aluminum oxide.

11. A process according to claim 10 wherein said weak acid is boric acid.

12. A process according to claim 7 wherein the thickness of said dielectric surface is about 0.5 micron to 20 microns.

* * * * *